US005682685A

United States Patent [19]

Terlizzi

[11] Patent Number: 5,682,685

[45] Date of Patent: Nov. 4, 1997

[54] DANCE SHOE SOLE

[75] Inventor: John Terlizzi, New Market, N.H.

[73] Assignee: Ballet Makers Inc., Totawa, N.J.

[21] Appl. No.: 542,138

[22] Filed: Oct. 12, 1995

[51] Int. Cl.[6] ..... A43B 5/12

[52] U.S. Cl. ..... 36/8.3; 36/25 R; 36/31; 36/102; 36/103

[58] Field of Search ..... 36/25 R, 8.3, 31, 36/77 R, 114, 102, 103

[56] References Cited

U.S. PATENT DOCUMENTS

| | | | |
|---|---|---|---|
| 4,519,148 | 5/1985 | Sisco | 36/103 |
| 4,541,186 | 9/1985 | Mulvihill | 36/43 |
| 4,542,598 | 9/1985 | Misevich et al. | 36/107 |
| 4,546,556 | 10/1985 | Stubblefield | 36/114 |
| 4,554,749 | 11/1985 | Ostrander | 36/31 |
| 4,706,316 | 11/1987 | Tanzi | 36/77 R |
| 4,924,606 | 5/1990 | Montgomery | 36/102 |
| 4,944,099 | 7/1990 | Davis | 36/102 |
| 4,947,560 | 8/1990 | Fuerst et al. | 36/114 |
| 5,111,597 | 5/1992 | Hansen et al. | 36/8.3 |
| 5,294,314 | 3/1994 | Moumdjian | 36/25 R |

FOREIGN PATENT DOCUMENTS

| | | | |
|---|---|---|---|
| 562697 | 9/1993 | European Pat. Off. | 36/103 |

*Primary Examiner*—M. D. Patterson

*Attorney, Agent, or Firm*—Ostrolenk, Faber, Gerb & Soffen, LLP

[57] ABSTRACT

A dancer's shoe, slipper or the like having a stiff sole comprised of split front and rear soles separated at the arch. To enable the dancer to stand on pointe, the front sole is "cup" shaped with a generally "C" shaped cross-section. The upstanding wall of the front sole is attached to the sides and may extend up the front of the shoe box. This enables the front sole to bend upward around an axis across the foot when the foot bends but prevents the front sole from bending downward around such an axis which enables the dancer to stand on pointe on the tip of the shoe. The wall may be notched to facilitate bending at a particular location. There may be a rear sole spaced from the front sole behind the arch. To stiffen the shoe body, a toe box is provided in the front portion of the shoe upper.

11 Claims, 4 Drawing Sheets

FIG. 8
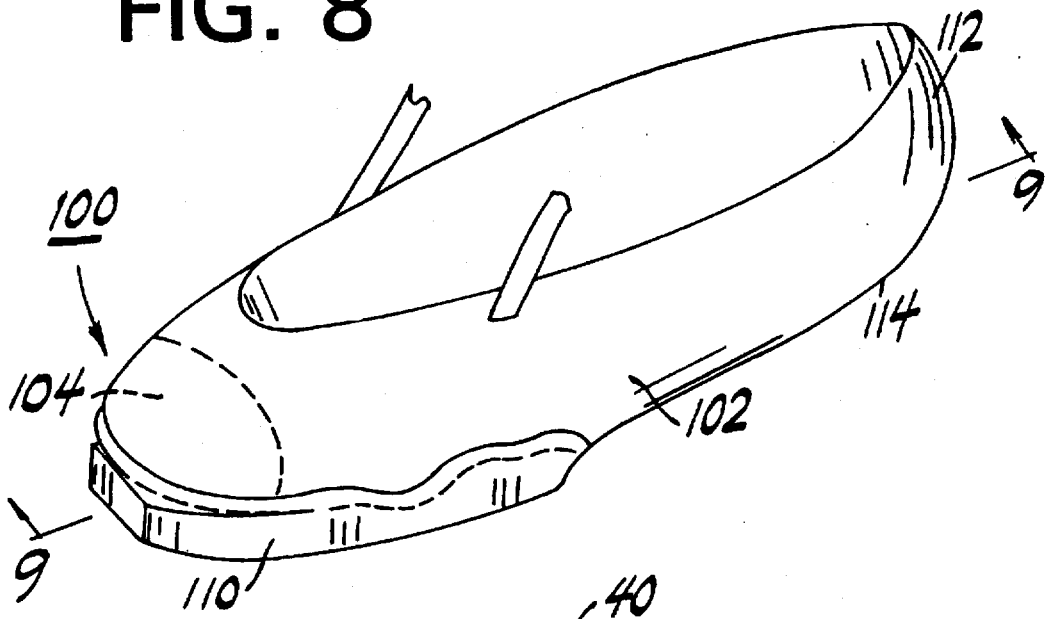
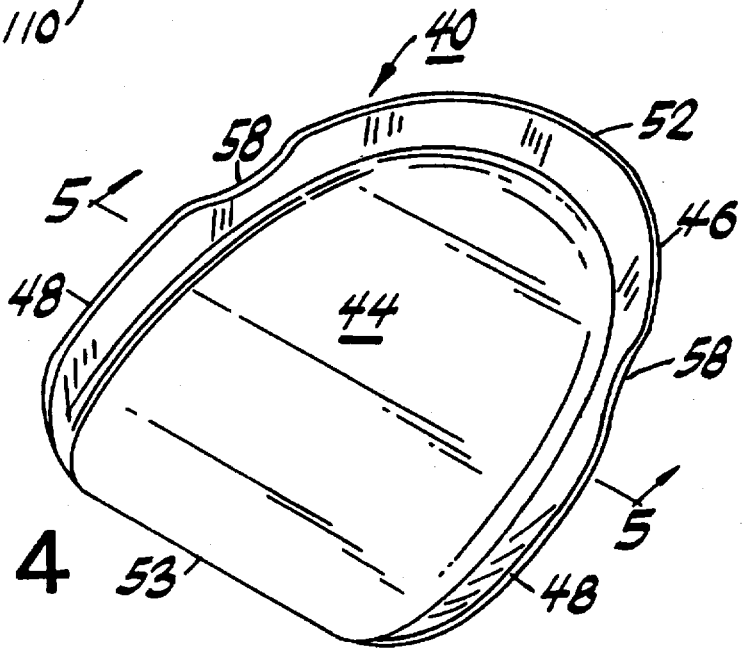
FIG. 4
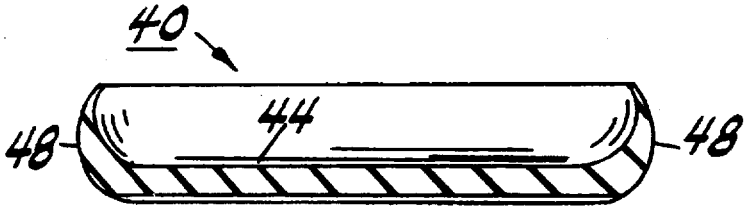
FIG. 5

DANCE SHOE SOLE

BACKGROUND OF THE INVENTION

The present invention relates to dance shoes, dance slippers, dance sneakers, and the like, which are worn by dancers, and particularly to such shoes worn for standing on pointe. Hereafter these shoes will generically be identified as pointe shoes.

A characteristic feature of a pointe shoe is that the front of the shoe, from the toe to the arch, is stiff and unbendable downward, that is around an axis at the base of the toes or at the ball of the foot and extending across the width of the foot. When a dancer stands in the pointe position, the foot is up on the front of the shoe at the ends of the toes. The front part of the foot up to the arch is nearly upright. The foot is bent downward around an axis across the width of the foot at the arch, so that the rear of the foot behind the arch is bent more down toward the floor than the front of the foot. To enable the dancer to hold the pointe position, the front of the shoe to the arch must be stiff, but the shoe must be flexible at the arch to enable the foot to be bent into the pointe position.

Pointe shoes achieve the required stiffness of their front portion through use of a rigid toe box and a rigid shank extending back from the toe box. The shank includes at least the part of the shoe beneath the front portion of the foot back at least to the arch. The rigid shank prevents the shoe and foot from bending downward around an axis across the foot at the rigid shank. The shank also prevents the front of the shoe and the foot in it from bending upward around an axis across the width of the shoe. This is contrary to the construction of a standard shoe which permits upward bending at various locations along the length of the shoe, e.g. at the base of the toes where they join the foot.

Dance shoes or slippers typically have a relatively thin, flexible material outsole, which touches the ground. Were it not for the rigid toe box and stiff shank described above, the front portion of that sole would easily flex and that would prevent use of the shoe as a pointe shoe.

Sneakers have been disclosed with a largely conventionally appearing laced upper and with a relatively thick outer sole; or outsole with midsole, which is beneath the shank and insole of the shoe. The outer sole extends the length of the shoe. To give the sneaker the required flexibility at the arch, the sole is split between a front sole that extends from the toe of the shoe up to about the arch region and a rear sole which extends from the rear of the arch region to under the heel. The space between the front and rear outer soles has no outsole, but instead has the approximate flexibility of the material of the shoe upper. See U.S. Pat. No. 4,542,598. The split sole sneaker has a front sole which is either not bendable easily in either direction or is bendable to the same degree both upward and downward around an axis across the foot. Because of the flexible middle region of the sneaker, the foot can be bent down around an axis extending across the foot at the arch.

SUMMARY OF THE INVENTION

Accordingly, it is the primary object of the present invention to provide a pointe shoe which is stiff at the front portion from the toe to the arch so that the front portion cannot bend downward around an axis across the shoe.

It is another object of the invention to provide a pointe shoe which is sufficiently flexible at the front portion of the shoe to bend up around an axis across the front portion of the shoe, e.g. at the base of the toes, unlike conventional pointe shoes.

According to the invention, the front sole at the front of the shoe is generally "cup" shaped, that is, it has a bottom that defines the bottom of the front sole and an upstanding side wall or periphery that is at least at the lateral sides of and may be wrapped around the entire periphery of the front sole of the shoe, so that in a cross section laterally across the shoe, the front sole is generally "C" shaped. The bottom of the front sole under the foot is of thin enough material that it can be bent around an axis across the shoe, as a conventional shoe sole bends. The "cup" or "C" cross-section shape of the front portion of the sole enables it to bend up around an axis generally across the shoe at the base of the toes and in the direction in which the foot normally bends during walking and movement. Yet, the peripheral side wall around the front sole prevents the sole from being bent in the reverse, downward direction, due to the geometry of the "C" shape cross-section of the sole. This enables the dancer to stand in a pointe position.

For additional protection of the dancer's toes when the dancer stands in the pointe position, the shoe may have a stiff toe box inside the front region of the shoe upper. The typical toe box is comprised of a generally triangular shape stiff material piece which is bent or curved into shape and fitted inside the front of the shoe upper, with the stiff box being open at its rear end to receive the dancer's toes are placed.

In the shoe of the invention, the rigidity of the front portion of the shoe is due to the front sole, not due to the combination of the toe box and stiff shank as in the standard pointe shoe.

The invention can be used on a split sole shoe, or on a shoe with only a front sole, or on a full sole shoe if it has a flexible arch portion that can be bent downward. The invention may be used with a dance sneaker, dance slipper or dance shoe and any pointe shoe.

Other features and advantages of the present invention will become apparent from the following description of a preferred embodiment of the invention considered in conjunction with the accompanying drawings, in which:

BRIEF DESCRIPTION OF THE DRAWINGS

FIG. 4 is a top perspective view of the front sole of the dance sneaker;

FIG. 5 is a cross sectional view along the arrows 5 in FIG. 4 of the front sole;

FIG. 8 is a perspective view of an alternate embodiment of a dance shoe according to the invention.

DESCRIPTION OF A PREFERRED EMBODIMENT

Figure 1:
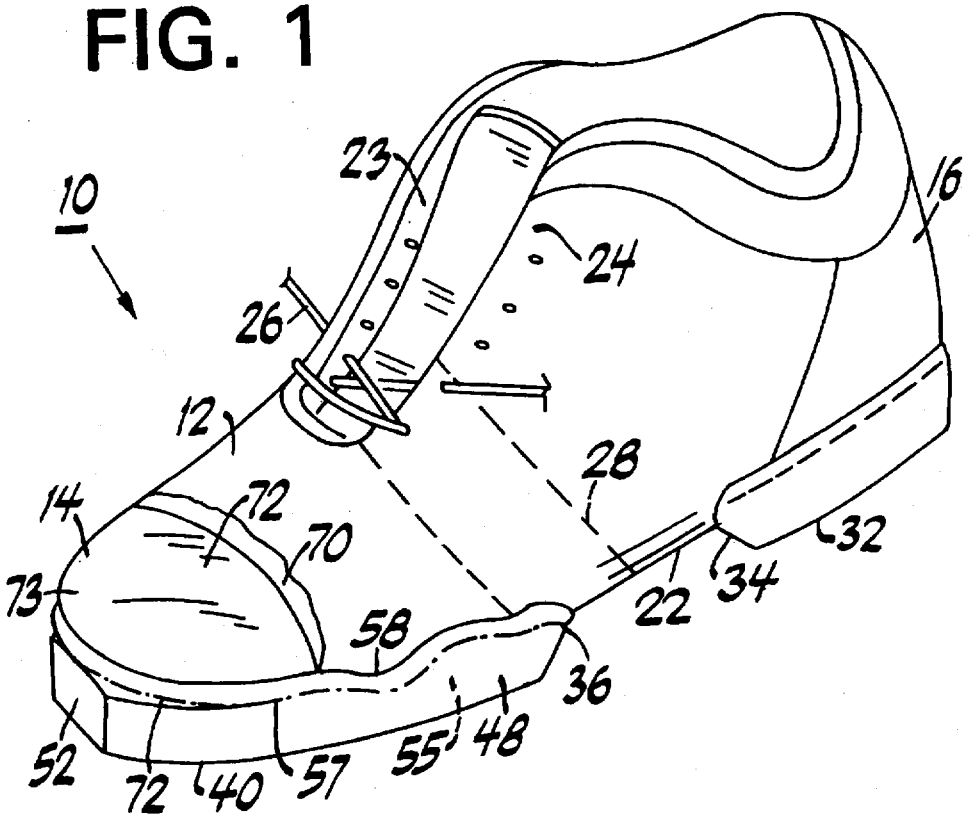
FIG. 1 is a perspective view of a dance sneaker showing a first embodiment of the invention.
Figure 2:
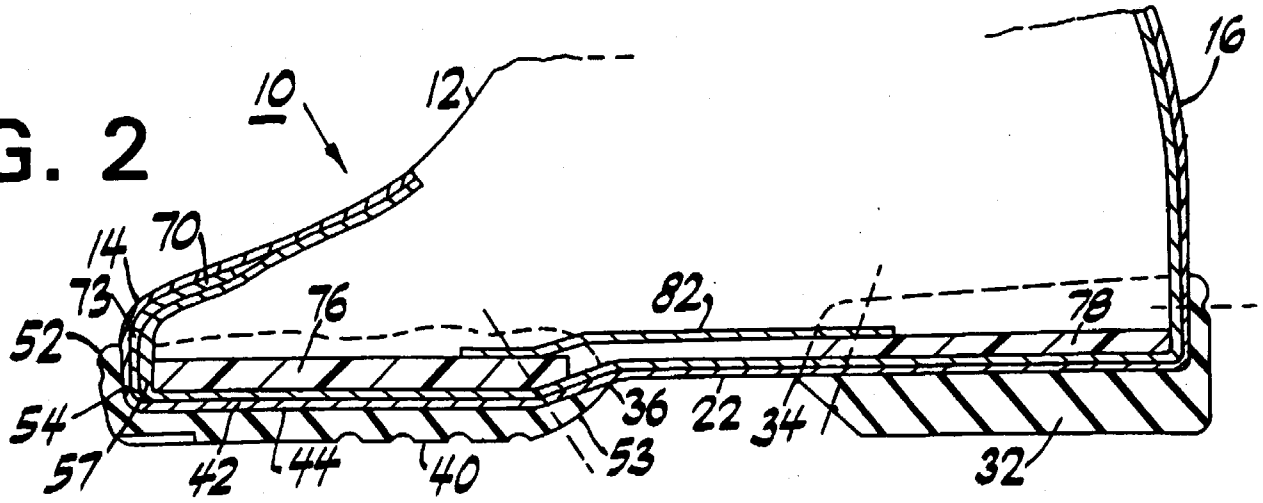
FIG. 2 is a longitudinal cross sectional view of the dance sneaker along the line 2—2 in FIG. 3.

The present invention is described first with reference to a dance sneaker, but it may be used for any pointe shoe. As shown in FIG. 1, the dance sneaker 10 comprises a shoe upper 12 which is comprised of flexible leather or canvas or both as typically used in producing a sneaker. The upper is flexible and somewhat stretchable. The shoe upper 12 has a front 14 and a rear 16, which are standard parts of a shoe. The midportion of the shoe upper at 20 including the bottom of the shoe upper at 22 are sufficiently flexible that the shoe upper can be bent from the flat condition shown in FIGS. 1 and 2 to either the bent downward condition in the pointe position shown in FIG. 6 or the bent upward, while walking position of FIG. 7. The illustrated shoe upper is divided at the top into two side parts 23, 24 which are laced at 26 to hold the two sides together and draw up and tighten the shoe upper on the foot, as is conventional with shoes. The interior of the shoe upper may have a reinforcing strip 28 within it to prevent stretching of the bottom 22 of the shoe without interfering with its flexibility.

The shoe 10 has a split sole. That includes a rear sole 32, which is thick and stiff to resist any bending or flexing. The rear sole extends rearwardly from the rear portion of the arch of the dancer's foot back to the heel. The bottom 22 of the midportion of the shoe upper extends forward from the front end 34 of the rear sole to the rear 36 of a front sole 40 according to the invention.

The front sole 40 as seen in FIGS. 4 and 5 is a generally "cup" shaped part that is applied beneath the front portion 14 of the shoe upper 12. The front portion 14 of the shoe upper has a bottom 42 beneath which the top side 44 of the front sole 40 is positioned.

The peripheral edge of the "cup" shaped front sole 40 projects upwardly defining a generally horseshoe shaped, peripheral upstanding wall 46 including opposite side walls 48 and a front wall 52, as well as a rearward gradually inclined wall 53. The rear of the front sole inclines upwardly at 53 to rear edge 36 and to the junction between the bottom of the front portion of the upper 42 and the bottom of the central portion of the upper at 22. The upstanding wall 46 is wrapped around the upstanding front end 54 and sides 55 of the bottom region of the front portion of the shoe upper 14. The front wall 52 of the wall 46 is not required, and the dancer can stand on pointe on the front or tip of the shoe body. The toe box is usually needed to stiffen the shoe enough so the dancer can stand on pointe. Absence of the front wall 52 does not prevent the side walls 48 from effectively resisting bending of the front side 40.

The cup shaped front sole 40 is fastened to the sides of the shoe upper around its periphery by a standard fastening technique, e.g. by adhesive, alone or reinforced, as by stitching 57.

The front sole 40 is of "C" shaped cross section, so that both its side walls 48 are of the same general height. Front wall 52, when one is present, is also of the same height. Each side wall 48 has a notch 58 in it, which slightly shortens the height of the side wall 48 at that notch, facilitating the bending of the front sole 40 around an axis across the foot at the base of the toes as described further below.

On the inside of the shoe, a stiffened toe box 70 is defined. As is conventional, it is comprised of a triangularly shaped piece of cloth which is bent so that two of its sides 72 extend down to the side of the foot near the bottom 42 of the shoe upper and its front at 73 wraps down over the front of the shoe upper and extends to the region covered by the front wall 52 of the front sole. Examples of materials for the toe box cloth include a non-woven material cloth impregnated with a thermoplastic resin or of polyvinylchloride, layers of cloth and cement, styrene, which substances are commonly used in shoes.

Inside the shoe there is a front insole 76 beneath the front part of the foot, a rear insole 78 beneath the rear part of the foot, and a connecting strip 82 between the front and rear insoles, completing the insole. The front insole 76 is flexible and may be a thin pad. The connecting strip 82 has great flexibility, since it should not interfere with the bending of the shoe in use.

Figure 6:
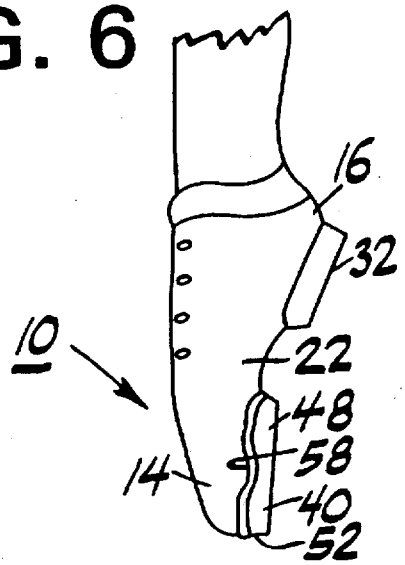
FIG. 6 illustrates the shoe in use in the pointe position.

The dance sneaker 10 has a stiff front sole 40 forward of the middle portion 22 of the upper and of the rear end 36 of the front sole. When a dancer stands in the pointe position, as shown in FIG. 6, the front portion 14 of the shoe remains stiff, unbent and upright, while the flexible middle portion 22 of the upper bends downwardly around an axis across the dancer's foot as the foot bends at the arch. The "cup" shape of the front portion 40 of the sole, and particularly its "C" shaped cross section with the upstanding side walls 48, prevents the front from flexing downward.

Figure 7:
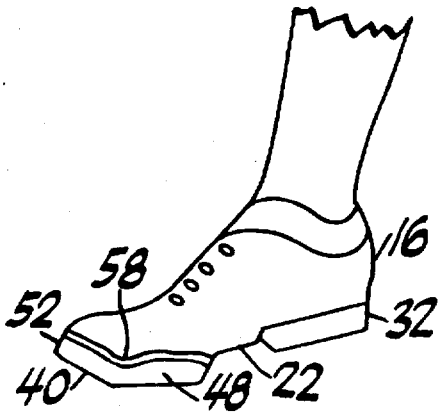
FIG. 7 illustrates the same shoe in a walking position.

However, as shown in FIG. 7, when the dancer walks forward and lifts the rear 16 of the shoe and the rear sole 32 of the shoe up and off the ground, the midportion 20, 22 of the shoe upper bends up as the foot is lifted and from the rear thereof forward, the front 14 of the'shoe tends to lift up as well. The front sole 40 has a C-shape which permits it to bend up as illustrated in FIG. 7. Its side walls 48 prevent the sole from bending downward, but permit it to bend up. The side walls 48 deflect outwardly when the shoe upper and front sole are bent upwardly around an axis across the shoe at the base of the toe.

To facilitate the upward bending and to help locate the bend at an axis approximately at the base of the toes, the notches 58 in the side walls 48 shorten the height of the walls and make them relatively more flexible at the notches so that the shoe and the front sole are likely to bend at the base of the toes where the notches are located. The notches are not so deep, however, as to enable the front sole to be bent downwardly around an axis through the notches.

Figure 3:
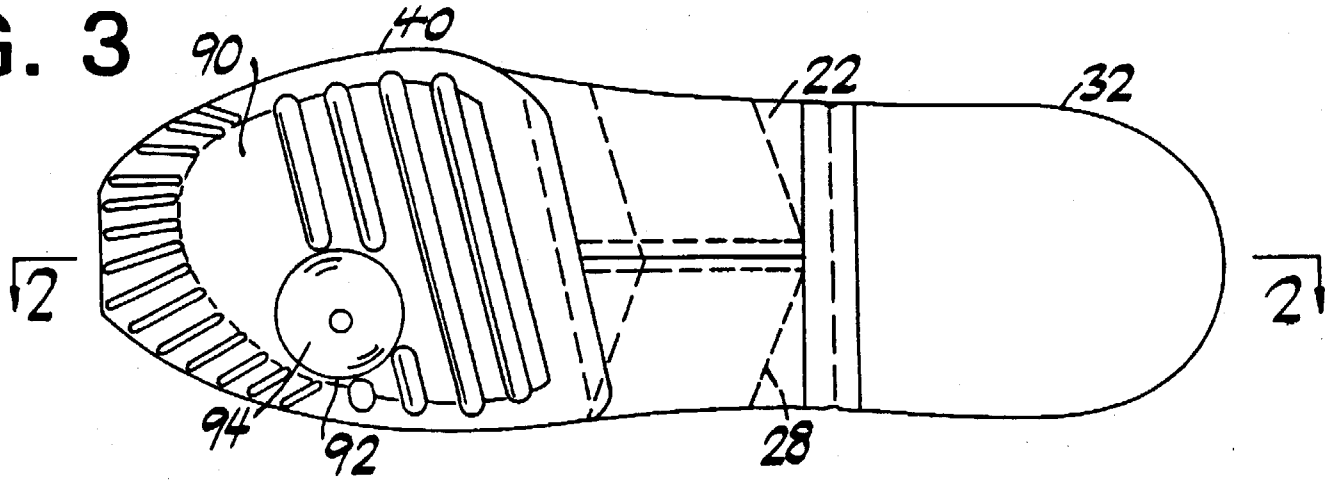
FIG. 3 is a bottom view of the dance sneaker of FIG. 1.

Referring to FIG. 3, the bottom 90 of the front sole 40 has a tread design selected for desired function, such as necessary traction, ability to make rapid movements and rapid changes of direction, to slide and spin, as dancers do. To enhance the dancer's ability to spin, the bottom of the sole is provided with a recessed area 92 which is placed in the sole beneath the ball of the foot under the large toe. In athletic shoes, a circular region of sole material is provided at that location to enable the wearer to pivot around the ball of the foot. But the circular region of material and the surrounding shoe area resists sliding and would inhibit a wearer spinning. The recessed area 92, in contrast, is slightly depressed at 94 into the sole, so that there is no material in contact with the floor or ground at the recess 92, rather than material being present. The absence of resisting material at the location of the recess 92 permits the dancer to more easily spin or swing around the location of the recess 92 as a pivot, than would be the case if the area of the recess were of material built up to contact the floor or ground.

Figure 9:
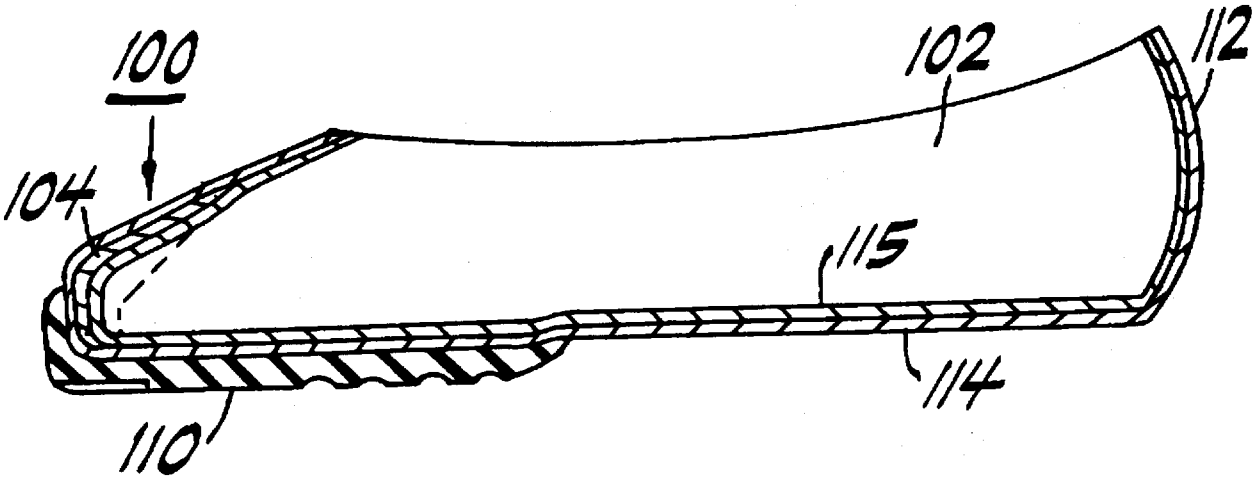
FIG. 9 is a cross sectional view along the line 9 in FIG. 8 showing the shoe of that embodiment.

The invention has been described on a dance sneaker. But it is also useful on a dance slipper or pointe shoe shown in FIGS. 8 and 9. That shoe is conventionally a soft bodied shoe 100 with a body 102 of a soft fabric like satin. The body includes a toe box 104 inside the body of the shoe. Use of the invention aovids the need for a shank, that is, a substantially flat plate that extends rearwardly from the toe box toward the arch beneath the foot is unnecessary.

A front sole 110 having the characteristic features of the front sole 40 of the first embodiment is installed on the front of the shoe 100. The front sole includes an upstanding peripheral wall that extends up a short height over the front and sides of the body 102 of the shoe and stiffens the front part of the shoe. Although the sole 110, like the front sole 40 is illustrated with the peripheral wall at and partly over the front of the shoe, that is unecessary. The toe box enables the dancer to stand on pointe.

The shoe 100 has a rear part 112 for the area of the foot at and to the rear of the arch up to the heel. To the rear of the front sole 110, the shoe has a flexible outsole 114 of leather, fabric or the like, as is conventionally on ballet shoes. Inside the shoe there is a flexible insole 115 which does not restrict upward bending of the foot or bending at the arch by a dancer on pointe.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dancer's shoe comprising a shoe body including a shoe upper shaped for receiving the dancer's foot, a mid-portion extending under the dancer's foot at least in the region of the arch of the foot; the upper including a front portion in which the toes may be received and having lateral sides at the sides of the shoe and a front end and including a rear portion;

a rear sole beneath the rear portion of the shoe and rearward of the mid-portion of the shoe; and a front sole fastened beneath the front portion of the shoe upper, the front sole including a part extending beneath the shoe body and including an upstanding side wall at each of the lateral sides of the shoe body; the front and rear soles being shaped so as to provide a gap without a sole portion that would contact the ground between the front and rear soles; the wall at each lateral side of the front sole being notched to shorten its height generally at a location defining an axis between the notches at the base of the dancer's toes to provide means for permitting the front sole and the shoe upper to which the front sole is fastened to bend upwardly around said axis between the notches by bending of the wall at the notches, and the height of the wall at the sides of the shoe, including at the notches, providing means for preventing bending of the shoe and the front sole downwardly around an axis across the shoe due to the resistance to bending provided by the wall.

2. The dance shoe of claim 1, wherein the front sole is fastened to the shoe upper around the lateral sides of the upper.

3. The dance shoe of claim 1, further comprising a toe box at the front portion of the shoe for stiffening the front portion of the shoe against deformation.

4. The dance shoe of claim 3, wherein the upstanding side wall of the front sole also extends along the front end of the shoe body and has a height that extends up sufficiently at said front end to provide means for defining an area on which the dancer may stand on pointe.

5. The dance shoe of claim 1, wherein the upstanding side wall of the front sole is also at the front end of the shoe body.

6. The dance shoe of claim 5, wherein the wall of the front sole at the front end of the upper has a height that extends up sufficiently at said front end to provide means for defining an area on which the dancer may stand on pointe.

7. The dance shoe of claim 1, wherein at the mid-portion between the front and rear soles, the upper of the shoe is of flexible shoe upper material enabling the shoe and the foot in the shoe to bend there.

8. The dance shoe of claim 1, wherein the front sole is thick enough to provide means for resisting easy flexing, yet is thin enough to provide means for being bent when the foot is bent upward around an axis across the shoe.

9. The dance shoe of claim 1, wherein the front sole is generally "cup" shaped, including the upstanding wall, the front sole having a cross section laterally across the front sole which is generally "C" shaped.

10. The dance shoe of claim 1, wherein the front sole has a bottom surface, a depressed recess in the bottom surface located beneath the ball of the dancer's big toe for facilitating a dancer's spinning on the sole.

11. The dance shoe of claim 10, wherein the recess is circular in shape.

* * * * *